US009339831B2

(12) United States Patent
Han de Man

(10) Patent No.: US 9,339,831 B2
(45) Date of Patent: May 17, 2016

(54) PUMP DEVICE AND FLOW CONTROL SYSTEM

(71) Applicant: MeadWestvaco Calmar Netherlands B.V., Richmond, VA (US)

(72) Inventor: Eelco Han de Man, Vlijmen (NL)

(73) Assignee: MeadWestvaco Calmar Netherlands BV, Norcross, GA (US)

( * ) Notice: Subject to any disclaimer, the term of this patent is extended or adjusted under 35 U.S.C. 154(b) by 0 days.

(21) Appl. No.: 14/421,360

(22) PCT Filed: Aug. 14, 2013

(86) PCT No.: PCT/EP2013/067028

§ 371 (c)(1),
(2) Date: Feb. 12, 2015

(87) PCT Pub. No.: WO2014/027041

PCT Pub. Date: Feb. 20, 2014

(65) Prior Publication Data

US 2015/0217315 A1 Aug. 6, 2015

Related U.S. Application Data

(63) Continuation of application No. 13/588,571, filed on Aug. 17, 2012, now abandoned.

(51) Int. Cl.

| | |
|---|---|
| ***B05B 11/00*** | (2006.01) |
| ***A45D 34/04*** | (2006.01) |
| *A45D 34/00* | (2006.01) |

(52) U.S. Cl.

CPC ..... *B05B 11/3035* (2013.01); *A45D 34/04* (2013.01); *B05B 11/3018* (2013.01); *B05B 11/3032* (2013.01); *B05B 11/3036* (2013.01); *B05B 11/3064* (2013.01); *B05B 11/3069* (2013.01); *A45D 2034/005* (2013.01); *A45D 2200/056* (2013.01)

(58) Field of Classification Search

USPC ..... 222/325–327, 386, 386.5, 130, 131, 222/183, 94–96, 105, 390

See application file for complete search history.

(56) References Cited

U.S. PATENT DOCUMENTS

| | | | | |
|---|---|---|---|---|
| 3,241,729 | A * | 3/1966 | Gabler | B65D 83/0027 222/390 |
| 4,782,983 | A * | 11/1988 | Cook | B65D 83/0005 116/307 |
| 4,983,061 | A | 1/1991 | Demarest | |
| 6,499,898 | B1 | 12/2002 | Garcia | |
| 7,467,734 | B2 * | 12/2008 | Bocola | B65D 83/0027 222/390 |
| 2002/0113093 | A1 * | 8/2002 | De Laforcade | B05B 11/0043 222/321.9 |

(Continued)

FOREIGN PATENT DOCUMENTS

| | | |
|---|---|---|
| EP | 2361527 | 8/2011 |

OTHER PUBLICATIONS

International Search Report from PCT/EP2013/067028 dated Oct. 22, 2013.

*Primary Examiner* — Donnell Long
(74) *Attorney, Agent, or Firm* — WestRock Intellectual Property Group

(57) ABSTRACT

A fluid delivery device (100) includes a pump (190), a fluid chamber (129) having an inlet (123) and two or more exits (126) wherein each of the exits (126) from the fluid chamber (129) are equidistant from the inlet (123) such that product pumped through the fluid chamber (129) may flow through each of the exits (126) at an equivalent rate.

11 Claims, 9 Drawing Sheets

(56) References Cited

U.S. PATENT DOCUMENTS

2008/0023487 A1* 1/2008 Douwes ..... A47K 5/1207
222/105
2010/0264166 A1* 10/2010 Moretti ..... B05B 11/0043
222/105
2010/0276447 A1* 11/2010 Patrini ..... B29C 49/18
222/105
2011/0031278 A1 2/2011 Han De Man
2011/0220682 A1* 9/2011 Lim ..... B05B 11/3074
222/183

* cited by examiner

PUMP DEVICE AND FLOW CONTROL SYSTEM

BACKGROUND OF THE INVENTION

1. Field of the Invention

Embodiments of the invention relate to pump and liquid dispersion devices and more particularly to pumps having an equidistant flow path for dispersion of a liquid across a particular surface area.

2. State of the Art

The personal and beauty care markets utilize a wide variety of different pump mechanisms and devices for delivering fluid-based products to a user. The pump devices include traditional pumps using ball valves or flap valves. Unique pump devices are also being developed to increase aesthetic value of the pump device or to provide new or improved functionality to the pump device or overall product package.

Typically, pumps or pump devices are connected to a bottle or other container holding a product. The product may be a fluid or a fluid mixed with solids or gases. The pump is used to deliver the product from the container to a user. In some instances, the container is a bottle and in other instances, the container may be a bag, a pouch, or a tube. In any event, it is often desirable that the pump evacuate most of the product from the container.

While pump devices are being used to deliver certain fluid products to users in the personal and beauty care field, they are not being used in all applications. For instance, in the field of under arm protection—or deodorant—pumps are not typically used. In some instances, deodorant is applied as a solid, in other instances as an aerosol, and in still other instances it may be applied as a gel or other liquid form. In those instances where the deodorant is in a gel or liquid form, pumps are not used to deliver the gel or liquid. Instead, a gel may be "pushed" using a screw-push mechanism or other piston which applies a force across a bottom surface area of the gel in a package, forcing gel out of holes in the top of a package. Such delivery systems are well known and commonly available in the market. Rollerballs may also be used with a liquid deodorant as known.

Although pumps are not currently used to distribute deodorants, it may be desirable to pump a gel or liquid deodorant or under arm protection product with a pump. It may also be desirable to maintain a user's customary experience with the application surface area of a deodorant package while providing a new delivery experience utilizing a pump. The use of a pump, and especially a pump in conjunction with a pouch, in deodorant packages may also be desirable.

BRIEF SUMMARY OF THE INVENTION

According to certain embodiments of the invention, a fluid delivery package may include a package shell, a pump and flexible package contained within the package shell, and a product flow path having two or more product outlets wherein the two or more product outlets are equidistant from a product outlet or discharge orifice of the pump. The product flow path may be defined in a package head. A package head may include a base portion and a top portion wherein the product flow path is defined in the base portion, the top portion, or a combination thereof and the two or more product outlets are defined in the top portion.

According to some embodiments of the invention, a fluid delivery package may include a package shell defining a space therein and a package head which may be assembled with the package shell to enclose said space. The package head may include a base portion and a top portion. The package shell or the package head may include an opening through which a portion of a pump may protrude or may be accessible. In other embodiments, an actuation button in communication with a pump may protrude through said opening or may be accessible by a user through said opening. The pump may be in communication with a flexible package—such as a flexible pouch—containing a product such that the pump may pump the product out of the flexible package and through a pump discharge passage. The pump discharge passage may be in communication with an inlet opening in the package head which may be positioned in the base portion of the package head. The inlet opening in the base portion may be centered or may be off-centered as desired. The inlet opening in the package head may be in communication with a product flow path. The product flow path may be defined by the base portion, the top portion, or a combination of the base portion and the top portion. The top portion may also include two or more holes or openings in communication with the product flow path. According to certain embodiments of the invention, the distance from the inlet opening to each of the two or more holes or openings is equal or substantially equal.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
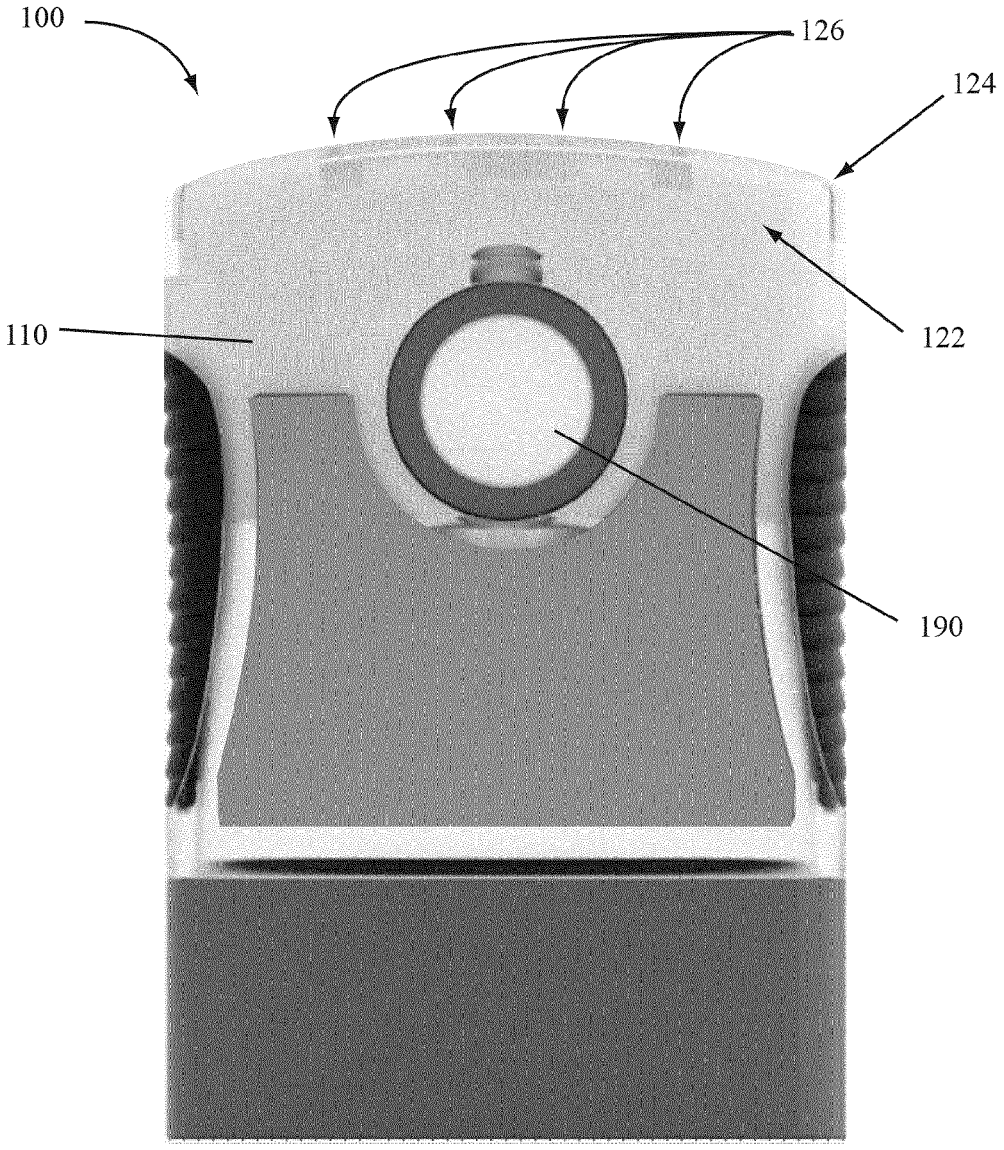
FIG. 1 illustrates a front view of a fluid delivery package according to various embodiments of the invention.
Figure 2:
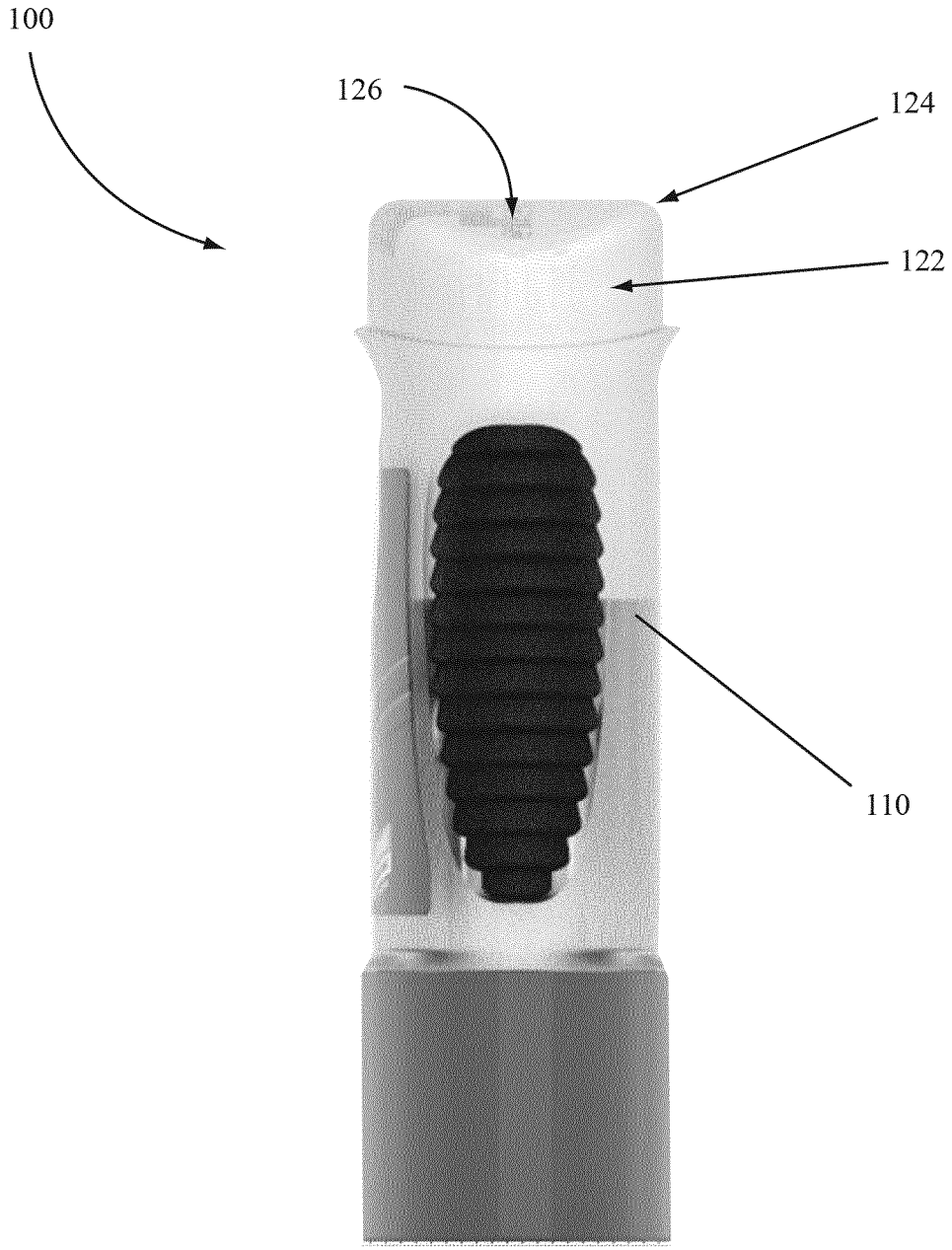
FIG. 2 illustrates a side view of a fluid delivery package according to various embodiments of the invention.

According to certain embodiments of the invention, a fluid delivery package 100 may include a package shell 110, a package head 120, and a pump 190. The package head 120 may include a base portion 122 and a top portion 124, the top portion 124 having one or more holes 126 product outlets, or openings therethrough. In many embodiments, the top portion 124 may have two or more holes 126 therethrough. The base portion 122 may include one or more inlet openings 123 which may be in communication with the pump 190. Examples of fluid delivery packages 100 according to various embodiments of the invention are illustrated in FIGS. 1 through 6.

According to embodiments of the invention, a package shell 110 may include two or more walls enclosing a space or cavity. In some embodiments, a shell 110 may include four sidewalls and a base with an opening in the top of the shell 110; for example, a rectangular box having an open end. In other embodiments of the invention, a shell 110 may include two open ends opposite each other. One of the open ends may be closed with a base portion 122 of a package head and the other end closed with a base plug 114. In still other embodiments of the invention, a shell 110 may be shaped in any desired shape as long as the shell 110 includes an interior cavity which may hold a container or pouch attached to a pump and used with the fluid delivery package 100.

A package head 120 according to embodiments of the invention may include a base portion 122 and a top portion 124. The base portion 122 may fit with, mate, or otherwise be configured to securely or removeably join with the package shell 110. Fitment or assembly of the base portion 122 with the package shell 110 may define an enclosed space or cavity within an interior of the package shell 110 and on an interior side of the base portion 122. The base portion 122 may also include one or more inlet openings 123. The one or more inlet openings 123 may be in fluid communication with a pump 190.

Figure 3:
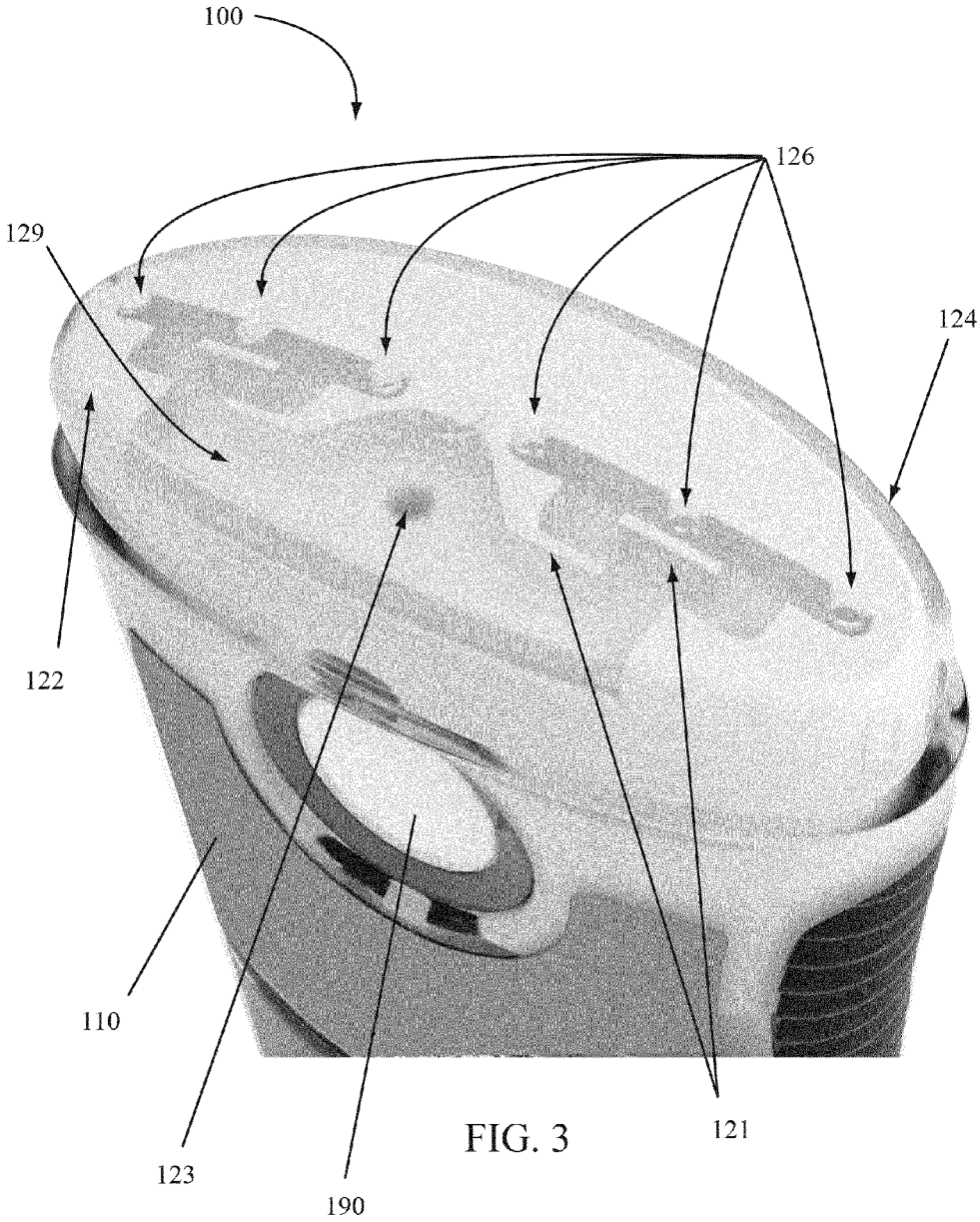
FIG. 3 illustrates a perspective view of a fluid delivery package and a fluid chamber of the fluid delivery package according to various embodiments of the invention.

According to certain embodiments of the invention, a top portion 124 of a package head 120 may include at least one and often two or more holes 126 or openings therethrough. In some embodiments, the base portion 122 and top portion 124 of the package head 120 may be secured together, creating a fluid chamber 129 between a top surface of the base portion 122 and a bottom surface of the top portion 124. A fluid flow path may be defined in or by the fluid chamber 129 between the one or more inlet openings 123 and the holes 126 in the top portion 124. For example, in some embodiments of the invention, a base portion 122 of a package head 120 may include one or more walls 121 which define one or more flow paths from an inlet opening 123 to one or more holes 126 in the top portion 124 of the package head 120 as illustrated in FIG. 3. Walls 121 may be configured in any desired configuration.

According to some preferred embodiments of the invention, the length of the fluid flow paths from an inlet opening 123 to each of two or more holes 126 in a top portion 124 of a package head 120 is equivalent or substantially equivalent. In other words, each of the two or more holes 126 is equidistant from the inlet opening 123 along the fluid flow paths. In such embodiments, the one or more walls 121 may be configured to ensure equidistant fluid travel paths from the inlet opening 123 to the two or more holes 126.

According to various embodiments of the invention, the equidistant fluid flow paths allow for an even distribution of product through two or more holes 126 in the package head 120. This equal distribution may be advantageous as it may allow a configuration of holes 126 which will provide equal amounts of product along the desired application surface of the package head 120. For example, the fluid flow paths from the inlet opening 123 through the fluid chamber 129 to the six holes 126 illustrated in FIG. 3 are all of the same length or substantially the same length. Thus, as the pump 190 is pumped and the fluid chamber 129 is filled with product, further pumping of the pump 190 will result in substantially the same amount of product exiting the holes 126 with each actuation of the pump 190. If the fluid flow paths were not of the same length, a non-equal distribution of product through the holes 126 may occur.

While equidistant fluid flow paths are desired, in some embodiments of the invention, non-equidistant flow paths may also be used with various configurations of a fluid delivery device 100. For example, it may be desirable to have a smaller flow of product along some portions of the package head 120 surface; thus, the holes 126 may be positioned at distances from the inlet opening 123 to accomplish the desired product distribution. In this manner, the product distribution across the surface of the package head 120 may be customized by varying the fluid flow path lengths and positioning of the holes 126, inlet opening 123, and walls 121.

According to some embodiments of the invention, the configuration of fluid flow paths through a fluid chamber 129 may be defined by walls 121 in the base portion 122 of the package head 120 as illustrated in FIG. 3. According to other embodiments of the invention, one or more walls 121 may project from the top portion 124 of the package head 120 rather than from the base portion 122. In still other embodiments of the invention, walls 121 may project from both the base portion 122 and the top portion 124 such that the combination of walls 121 defines fluid flow paths through the fluid chamber 129.

Figure 4:
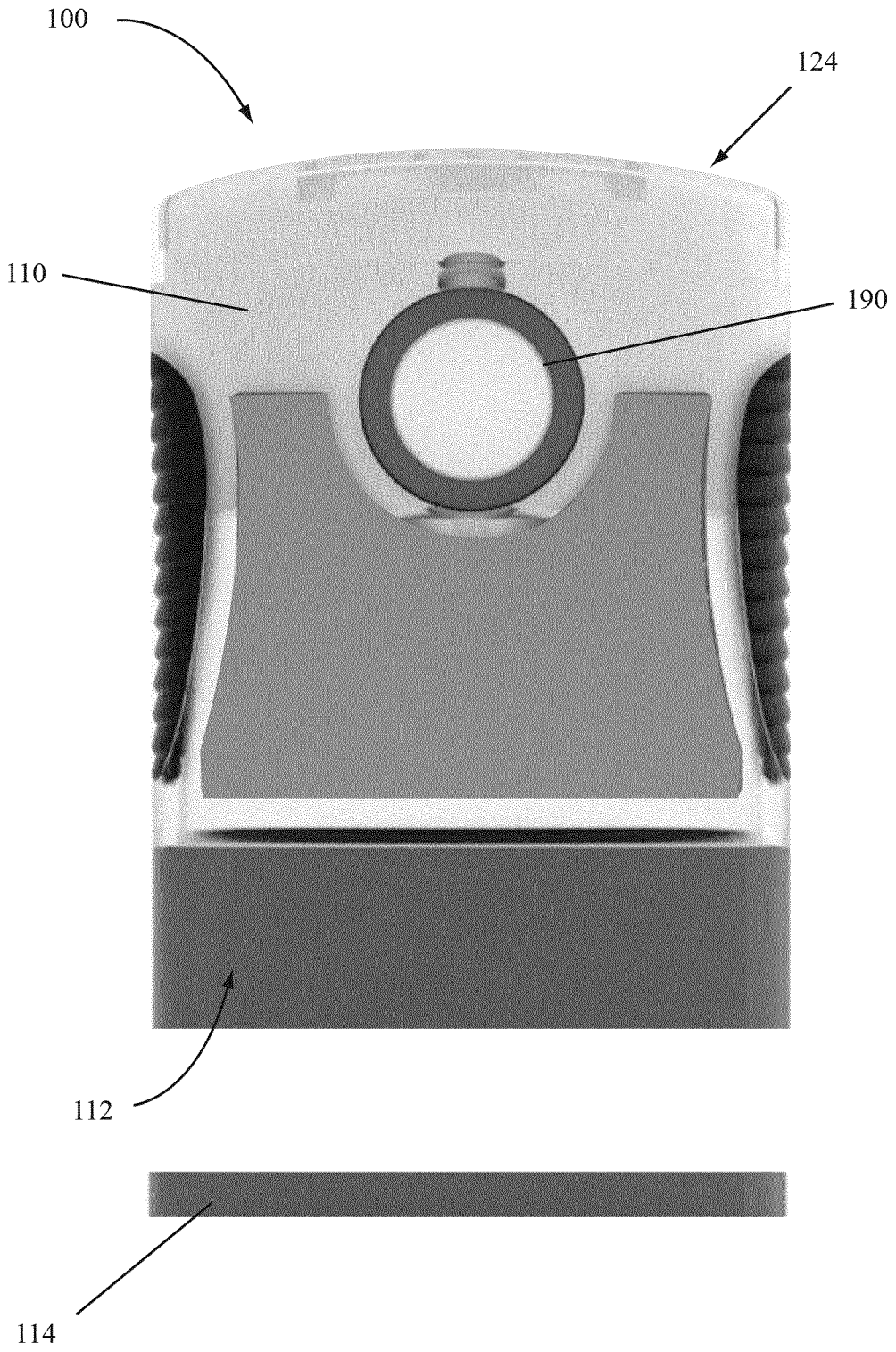
FIG. 4 illustrates a front view of a partially disassembled fluid delivery package according to various embodiments of the invention.

According to certain embodiments of the invention, a package shell 110 and base portion 122 of the package head 120 may be molded as a unitary, molded component. The package shell 110 may include an opening in the base 112 of the package shell 110 as illustrated in FIG. 4. A base plug 114 may be inserted, fitted, mated, or otherwise joined to the base 112 of the package shell 110 to create an interior cavity within the package shell 110. In other embodiments, the base 112 of the package shell 110 may be left open, exposing an interior cavity within the package shell 110.

In those embodiments where the base 112 of the package shell 110 is open, a pump 190 and flexible pouch 195 or container filled with product may be assembled or inserted through the opening in the base 112 of the package shell 110 and assembled with the package shell 110 such that the pump 190 may be actuated and such that a discharge passage of the pump 190 is in communication with an inlet opening 126 in the package head 120. A base plug 114 may be inserted into the base 112 of the shell 110 as desired. In some embodiments, a base plug 114 may not be used. The pump 190 and flexible pouch 195 may be used as refills as well, where the pump 190 and flexible pouch 195 may be removed and replaced with another pump 190 and flexible pouch 195 combination as desired. In this manner, a shell 110 may be reused.

Figure 5:
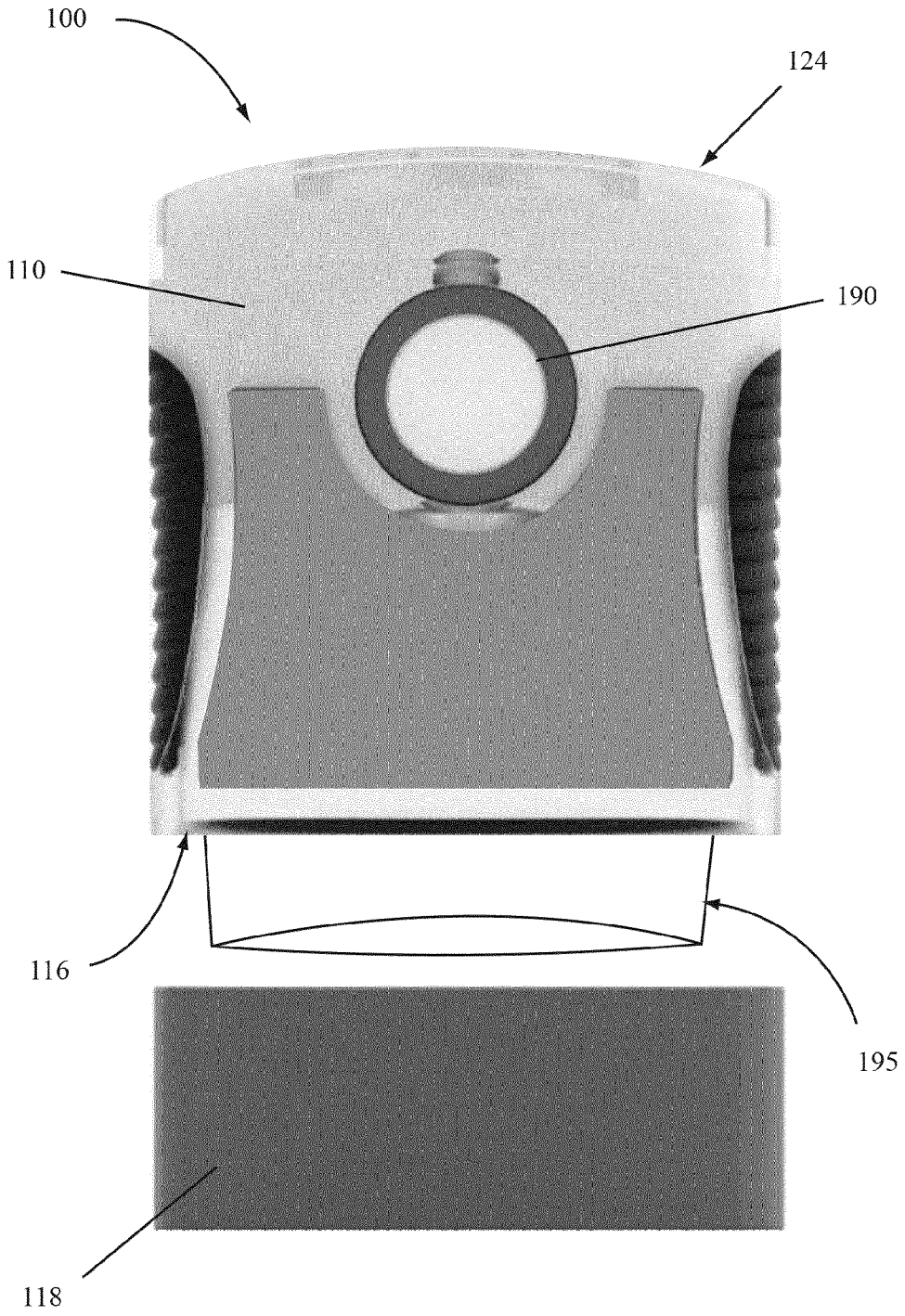
FIG. 5 illustrates a front view of a partially disassembled fluid delivery package according to various embodiments of the invention.

In other embodiments of the invention, the shell 110 may include a top shell portion 116 and a bottom shell portion 118 which may be fitted together, mated, or otherwise joined for operation. The top shell portion 116 and bottom shell portion 118 may be separated to expose a flexible pouch 195 as illustrated in FIG. 5. In addition, the top shell portion 116 and bottom shell portion 118 may be separated such that refills may be added to the fluid delivery package 100.

Figure 6:
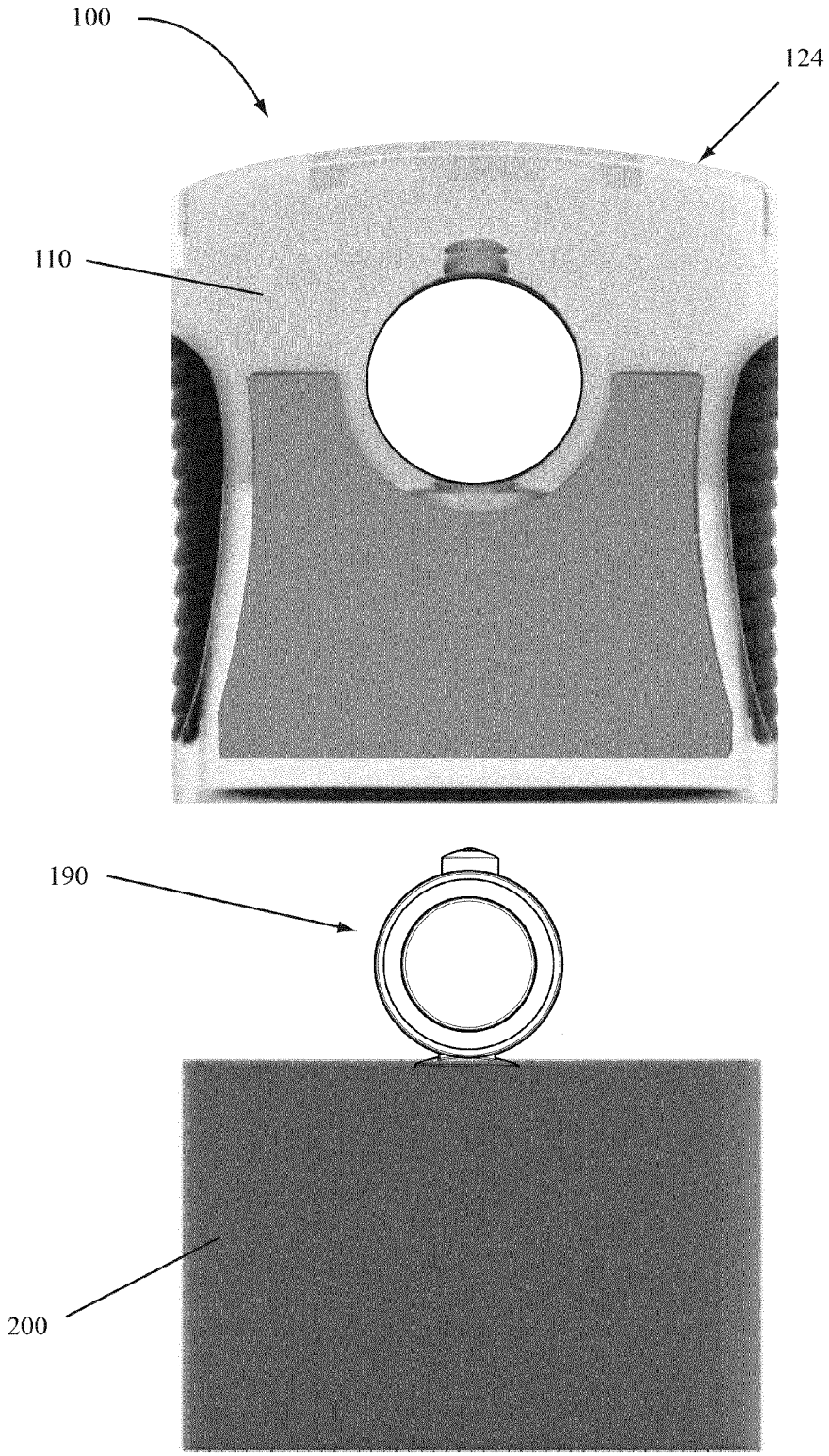
FIG. 6 illustrates a front view of a partially disassembled fluid delivery package according to various embodiments of the invention.

In still other embodiments of the invention, a pump 190 may be integrated with a container 200 as illustrated in FIG. 6. The container 200 may be rigid or may include both rigid and flexible portions. The pump 190 and container 200 may be inserted into an the open base 112 end of the package shell 110 and the container 200 may mate with, snap into, or otherwise seal or become fixed to the package shell 110. In some instances, a container 200 and pump 190 combination may be used as a refill system with the shell 110 whereby a pump 190, container 200, and product may be sold and the pump 190, container 200, and product may be replaced at will in the shell 110 of the fluid delivery package 100.

According to various embodiments of the invention, a pump 190 may include any desired pump. In some instances, a pump 190 may include a pump such as any of those illustrated and described in U.S. patent application Ser. No. 12/912,241 published as US-2011-0031278-A1, which is incorporated herein by reference in its entirety. For example, a pump 300 as illustrated in FIGS. 7 through 11 may be incorporated into a fluid delivery package 100 according to embodiments of the invention.

In some embodiments of the invention, a pump 300 may include the components illustrated in FIGS. 7A through 7D.

Figure 7A:
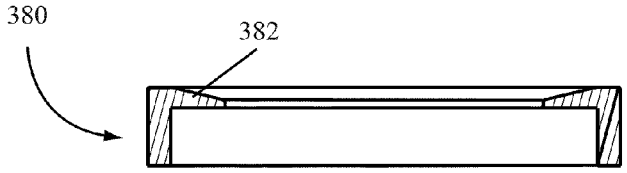
FIGS. 7A through 7D illustrate cross-sectional views of various components of a pump which may be used with embodiments of the invention.
Figure 7B:
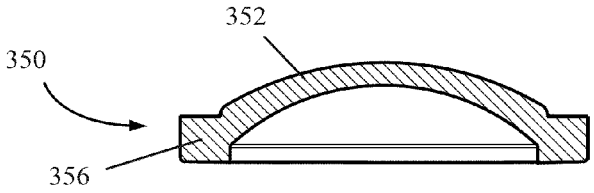
Figure 7C:
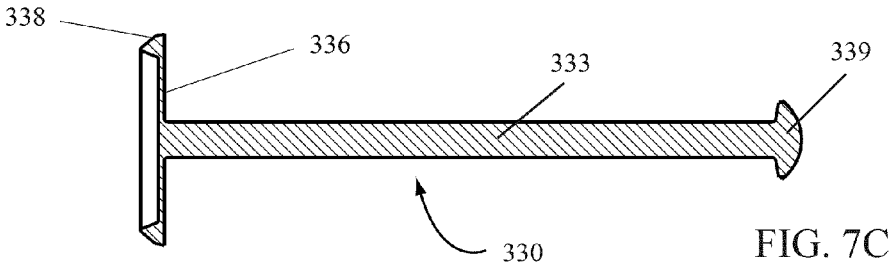
Figure 7D:
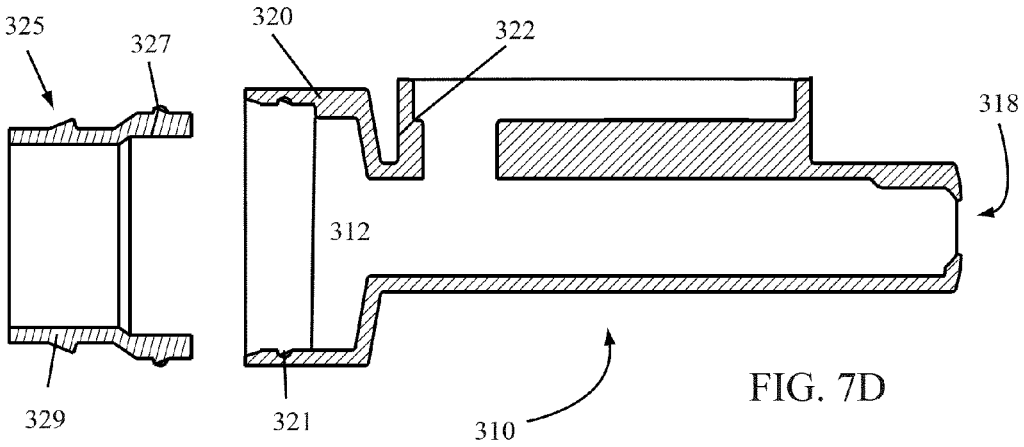

A pump 300 base 310 according to various embodiments of the invention is illustrated in FIG. 7D. The base 310 may include a container attachment 320, an inlet passage 312, an interior chamber 314, a base rim 322 and a discharge passage 318. The container attachment 320 may include any desired attachment device for attaching the base 310 or the pump 300 to a container such as a bottle, tube, bag, pouch or flexible container or packaging. In some embodiments of the invention, the container attachment 320 may also contain an attachment feature 321 for mating with or attaching to an attachment adapter 325. An attachment adapter 325 may include an adapter attachment feature 327 configured to mate with or otherwise attach to the attachment feature 321. An attachment adapter 325 may also include one or more connecter flanges 329. A connecter flange 329 may be used to attach to a container or to hold a container onto the attachment adapter 325 for assembly or mating to a pump 300. An adapter attachment 325 may also contact other parts of a pump 300 and may assist in assembling a pump 300.

An inlet passage 312 may allow a product to flow from a container into a portion of the interior chamber 314 of the base 310. The interior chamber 310 may include a hollow passage into which a valve 330 may fit or be seated. The shape, size, dimensions, and other features of the interior passage 345 may be altered or modified as desired. The base 310 or a portion of the interior chamber 345 may also include a base rim 322. The discharge passage 318 may be positioned opposite the inlet passage 312 or on the opposite side of the interior chamber 345 from the inlet passage 212. As illustrated in FIG. 7D, the discharge passage 318 may include an opening in the base 310.

According to various embodiments of the invention, the base 310 may be molded as a single piece or component. In other embodiments, the base 310 and the attachment adapter 325 may be molded as separate components and assembled to form a unitary piece. The base 310 and attachment adapter 325 may be molded or formed from any desirable material, including, for example, a resin material or a plastic material which may be molded using conventional molding techniques.

A valve 330 for a pump 300 according to various embodiments of the invention is illustrated in FIG. 7C. A valve 330 may include a valve stem 333, an outlet valve 339 at one end of the valve stem 333, and a valve disc 336 at an end of the valve stem 333 opposite the outlet valve 339. A valve rim 338 may circle or circumscribe a portion of the valve disc 336 or may be located anywhere desired on the valve disc 336. For example, as illustrated in FIG. 7C a valve rim 338 may be located on an outer rim of a valve disc 336.

A valve 330 according to various embodiments of the invention may be formed of any desired material. In some embodiments of the invention, the valve 330 may be a molded component. The valve 330 may be made of a flexible material or other moldable material. For example, the valve 330 may be made of silicon, a TPE material, or a TPU material.

A bellow 350 according to embodiments of the invention is illustrated in FIG. 7B. A bellow 350 may include a bellow dome 352, a bellow chamber 358, and a bellow rim 356. The bellow chamber 358 may be defined by the shape of the bellow dome 352. Different sizes and shapes of the bellow chamber 358 may be created by altering the shape or size of the bellow dome 352.

A bellow 350 may be formed of any desired material. In some embodiments of the invention, a bellow 350 may be a material that may be deformed but which will return to its original shape after a force causing such deformation is removed. For example, the bellow 350 may be made of silicon, a TPE material, or a TPU material. The bellow dome 352 may be deformed to change the volume or shape of the bellow chamber 358. As the bellow dome 352 is deformed, the remainder of the bellow 350 may flex or deform in a corresponding manner as desired.

A cap 380 according to various embodiments of the invention is illustrated in FIG. 7A. A cap 380 may include a cap flange 382. According to various embodiments of the invention, a cap 380 may be attachable to the base 310 or to another portion of a pump 300 to keep the various components of a pump 300 assembled. For example, the cap 380 illustrated in FIG. 7A may be positioned over a bellow 350 and a base 310 to secure the bellow 350 in an appropriate position with respect to the base 310. A cap 380 according to various embodiments of the invention may include any desired means for securing the cap 380 to the base 310 or other portion of the pump 300. For instance, the cap 380 may be screwed onto the base 310, may frictionally fit to the base 310, may be welded or glued to the base 310 or may be snapped onto the base 310. In various embodiments, the base 310 may include features which assist with the connection of the cap 380 to the base 310, such as corresponding lugs, screw channels, or other features needed to secure the cap 380 to the base 310.

Figure 8:
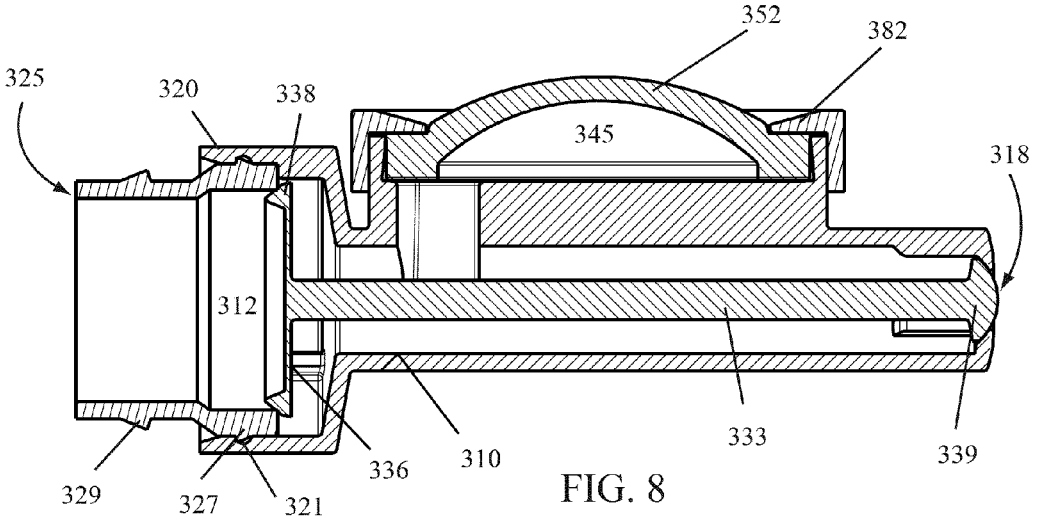
FIG. 8 illustrates a cross-sectional view of a pump according to various embodiments of the invention.

A pump 300 according to various embodiments of the invention may include a base 310, an attachment adapter 325, a valve 330, a bellow 350, and a cap 380 fitted together as illustrated in FIG. 8. According to embodiments of the invention, a valve 330 may fit within the interior chamber 314 of the base 310 such that the outlet valve 339 mates with the discharge passage 318 of the base 310. The outlet valve 339 may seal or close the discharge passage 318 when positioned in the interior chamber 314. The valve stem 333 may extend through the interior chamber 314 terminating in the valve disc 336 in the inlet passage 312. A portion of the attachment adapter 325, when assembled to the base 310, may contact a portion of the valve rim 338 of the valve disc 336 and may assist in positioning or holding the valve 330 in the base 310. As illustrated in FIG. 8, the attachment adapter 325 may be fitted to the base 310 such that the adapter attachment feature 327 fits with the attachment feature 321 of the base 310. Such attachment may secure the attachment adapter 325 to the base 310 and hold valve 330 within the interior chamber 314 of the base 310.

A bellow 350 may rest or be positioned on a portion of a base rim 322 as illustrated in FIG. 8. A bellow rim 356 may rest on a portion of the base 310 and on the base rim 322. According to embodiments of the invention, the bellow chamber 358 may be in communication with the interior chamber 314 of the base 310, thereby forming a pump chamber 345 when the bellow 350 is assembled to the base 310. A cap 380 or other securing mechanism fitted over a portion of the bellow 350 and the base 310 may hold the pump 300 together. For example, as illustrated in FIG. 8, the cap 380 may fit over the base 310 and the cap flange 382 may extend over a portion of the bellow rim 356. The cap 380 may be secured to the base 310 and the cap flange 382 may hold the bellow 350 in the desired position for the pump 300.

FIGS. 12 through 15 illustrate the operation of a pump 300 according to embodiments of the invention. As illustrated in FIG. 8, when the pump 300 is in a resting position, the pump chamber 345 is a closed volume defined by the bellow dome 352 and the interior chamber 314 of the base 310. The valve 330 positioned within the interior chamber 314 may seal both the inlet passage 312 and the discharge passage 318 of the pump 300.

Figure 9:
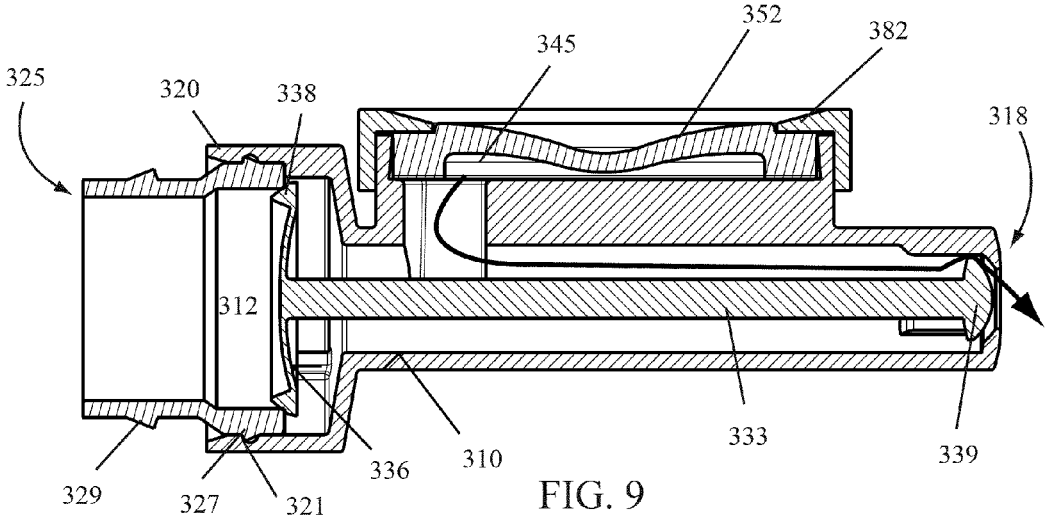
FIG. 9 illustrates a cross-sectional view of a pump according to various embodiments of the invention.

A force may be applied to the bellow dome 352 as illustrated in FIG. 9. When a force is applied to the bellow dome 352, the bellow dome 352 may be deformed as illustrated. The deformation of the bellow dome 352 alters the volume within the pump chamber 345. A product stored in the pump chamber 345 may be moved by such deformation. The valve disc 336 may be flexible such that when a force is applied to the product or the volume of the pump chamber 345 is altered, product may push on the valve disc 336 causing it to flex. Flexion of the valve disc 356 may move the valve stem 333 in the direction of the flexion and may cause the outlet valve 339 to disengage from the discharge passage 318, opening the discharge passage 318. When the discharge passage 318 is opened, product from within the pump chamber 345 may exit the pump 300 in the direction indicated by the arrow in FIG. 9.

Figure 10:
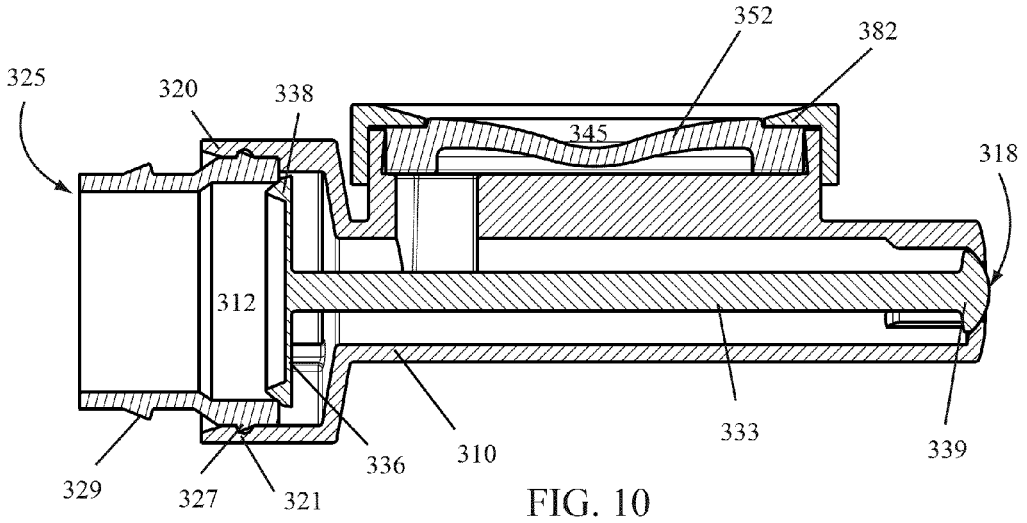
FIG. 10 illustrates a cross-sectional view of a pump according to various embodiments of the invention.

As illustrated in FIG. 10, when a force is removed from the bellow dome 352 or sufficient product in the pump chamber 345 has escaped the pump chamber 345, the valve disc 356 may return to its original position. Movement of the valve disc 356 to an original position may return the valve stem 333 to an original position which may close the outlet valve 339 and discharge passage 318.

Figure 11:
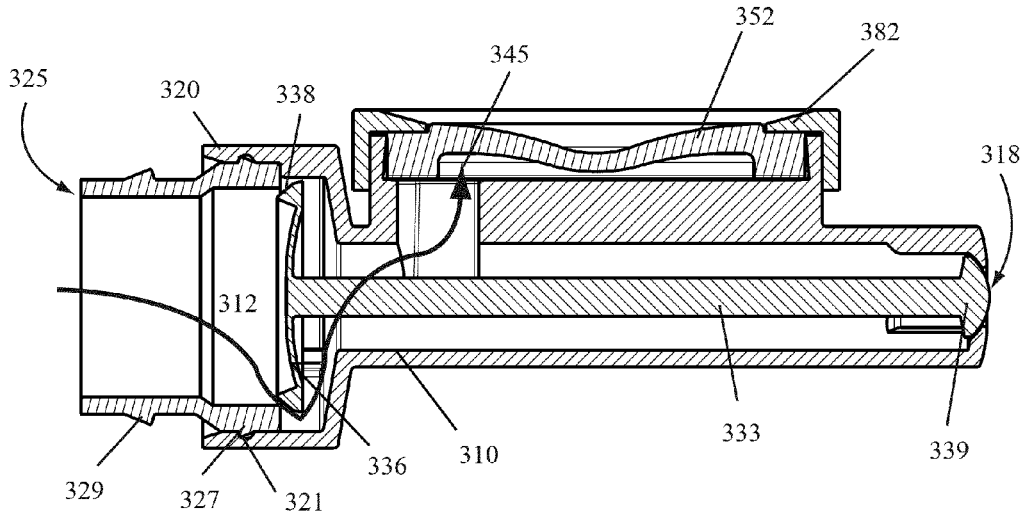
FIG. 11 illustrates a cross-sectional view of a pump according to various embodiments of the invention.

Following the release of the force on the bellow dome 352, the bellow dome 352 may begin to return to its original form or shape as illustrated in FIG. 11. As the bellow dome 352 retracts or moves back into its original position or shape, a vacuum may be formed within the pump chamber 345. The vacuum may act on the valve 330 such that the valve disc 356 flexes away from the inlet passage 312 and such that at least a portion of the contact between the valve rim 338 and the attachment adapter 325 is broken. Once the valve rim 338 is separated from contact with the attachment adapter 325, product from a container may flow through the inlet passage 312, past the valve rim 338 and valve disc 336 and into the pump chamber 345. In this manner, the pump chamber 345 may refill with product from the container. For example, product may flow from a container through the inlet passage 312 and into the pump chamber 345 along the path illustrated by the arrow in FIG. 11.

When the bellow dome 352 returns to its original shape or position, or when the vacuum force is insufficient to flex the valve disc 336, the valve rim 338 may again contact the attachment adapter 325 and form a seal between the valve 330 and the attachment adapter 325 as illustrated in FIG. 8.

As illustrated in FIGS. 12 through 15, a product may be pumped through the pump 300 by actuating the bellow dome 352 of the pump 300. When actuated, product in the pump chamber 345 may be forced out of the pump chamber 345 and through the discharge passage 318. In some instances, the product may follow the path illustrated in FIG. 9. Upon reducing or ceasing actuation of the bellow dome 352, the bellow dome 352 may return to its original position, drawing product from a container attached to the pump 300 through the inlet passage 312 and into the pump chamber 345. For example, product may enter the pump chamber 345 along the path illustrated in FIG. 11. In this manner, a pump 300 may be actuated to dispense a product from a container attached to the pump 300.

According to some embodiments of the invention, the base portion 122 of a package head 120 may be molded with or as an integral component of the pump 190. For example, a pump base 310 as illustrated in FIG. 7D may be molded as a part of or with the base portion 122 of the package head 120, thus reducing the number of parts required to assemble a fluid delivery device 100. The pump 190 could then be assembled with the package head 120 and sealed to a flexible pouch 195 having a product therein. The package head 120, pump 190, and flexible pouch 195 combination could then be assembled with a shell 110 to form a fluid delivery package 100.

According to various embodiments of the invention, a fluid delivery device 100 may be used as a deodorant delivery device. For example, a fluid delivery device as illustrated in FIGS. 1 through 6 may be fitted with a pump 300 as illustrated in FIGS. 7 through 11. The pump 300 may be integrated with or connected to a container or flexible pouch having a deodorant product, such as a gel, contained therein. The pump 300 may be integrated with or snapped into the shell 110 such that the bellow dome 352 is accessible through, or extends through, an opening in the shell 110 as illustrated. A discharge passage 318 of the pump 300 may contact or fit with an inlet opening 123 in the package head 120. In other embodiments the package head 120 and pump base 310 may be integrally molded such that the discharge passage 318 and inlet opening 123 are integrated or a common passage. Two or more holes 126 in a top portion 124 of the deodorant delivery device may be in fluid communication with the inlet opening 123 and each of the two or more holes 126 may be equidistant from the inlet opening 123.

Upon actuation of a bellow dome 352 in such a configuration, fluid—or a deodorant gel or liquid—may be pumped from the container or pouch, through the pump 300, and out the discharge passage 318 of the pump 300. Product exiting the discharge passage 318 may pass into and through the inlet opening 123 and into a fluid chamber 129. As fluid is pumped into the fluid chamber 129, the fluid chamber 129 fills with the fluid and fluid moves towards the two or more holes 126. As fluid passes through the fluid chamber 129 it may exit through the two or more holes 126. Once the fluid chamber 129 is filled with fluid, the volume of distribution of product through the two or more holes 126 may be equivalent do to the equal distance between the two or more holes 126 and the inlet opening 123.

While fluid delivery devices 100 according to embodiments of the invention work best when the two or more holes 126 are equidistant from the inlet opening 123, other embodiments of the invention may include holes 126 which are not equidistant from the inlet opening 123.

In still other embodiments of the invention, two or more inlet openings may be included in a liquid delivery device 100 and two or more products may be pumped from a container or two or more pouches into a fluid chamber 129. For example, a pump 190 may be configured to pump two products through two different inlet openings 123 in a package head 120. The pump 190 may be a single pump or two pumps. In addition, each side of a shell 110 may include an opening for a pump 190 such that two pumps 190 may be assembled with a shell 110 such that the pump bellows 352 are located on opposite sides of the shell 110.

While particular aesthetic configurations are illustrated, embodiments of the invention are not restricted to these configurations. Further, location of the inlet opening 123 in a package head 120 is not limited to the positions illustrated and described herein. In addition, the number, placement, and size of the two or more holes 126 may also vary from those configurations illustrated and described herein.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A fluid delivery package, comprising:

a package shell;

a package head attached to the package shell, comprising:

a base portion;

an inlet opening in the base portion;

a top portion fitted to the base portion;

a plurality of holes in the top portion;

at least one wall in the base portion, wherein the at least one wall defines a plurality of flow paths between the inlet opening and each of the plurality of holes, wherein each of the plurality of flow paths are equidistant; and a pump in fluid communication with the inlet opening of the base portion.

2. The fluid delivery package of claim 1, wherein the package shell and the base portion are a unitary component.

3. The fluid delivery package of claim 1, further comprising a base plug inserted in an end of the package shell opposite the package head.

4. The fluid delivery package of claim 1, further comprising a flexible pouch attached to the pump.

5. The fluid delivery package of claim 1, further comprising a flexible pouch attached to the pump and a deodorant product in the flexible pouch.

6. The fluid delivery package of claim 1, wherein the pump may be removed from fluid communication with the inlet opening and replaced with a new pump.

7. The fluid delivery package of claim 1, wherein the pump further comprises a bellow pump.

8. The fluid delivery package of claim 1, wherein the pump further comprises:

a base;

an attachment adapter;

a valve;

a bellow; and a cap.

9. A fluid delivery package, comprising:

a package shell;

a package head attached to the package shell, comprising:

a base portion;

an inlet opening in the base portion;

a top portion fitted to the base portion;

a plurality of holes in the top portion;

a plurality of flow paths, each of the plurality of flow paths defining a flow path from the inlet opening to one of the plurality of holes, wherein each of the flow paths have the same length; and a pump in fluid communication with the inlet opening and an interior of the package shell.

10. The fluid delivery package of claim 9, wherein the package shell and base portion are a unitary component.

11. The fluid delivery package of claim 9, further comprising a flexible pouch contained within the package shell.

* * * * *